US006155460A

United States Patent [19]

Lee

[11] Patent Number: 6,155,460

[45] Date of Patent: Dec. 5, 2000

[54] BOTTLED WATER DISPENSER FILLING DEVICE AND KIT THEREFORE

[76] Inventor: Jonathon Lee, 17011 Green Dr., City of Industry, Calif. 92705

[21] Appl. No.: 09/302,930

[22] Filed: Apr. 30, 1999

[51] Int. Cl.[7] ..... B65B 1/04

[52] U.S. Cl. ..... 222/146.6; 227/385

[58] Field of Search ..... 222/146.6, 189.1, 222/146.1, 372, 373, 375, 383.1, 383.2, 385

[56] References Cited

U.S. PATENT DOCUMENTS

| | | | |
|---|---|---|---|
| 3,806,004 | 4/1974 | Kolkovsky | 222/385 |
| 4,174,743 | 11/1979 | Beny et al . | |
| 4,735,345 | 4/1988 | Lee | 222/131 |
| 5,495,725 | 3/1996 | Middlemiss . | |
| 5,638,991 | 6/1997 | Todden et al. . | |

*Primary Examiner*—Steven O. Douglas

[57] ABSTRACT

The present invention is a novel pump and regulator which may optionally be combined with a collapsible enclosing cabinet for the pump and water bottle to form a kit.

12 Claims, 7 Drawing Sheets

FIGURE 9
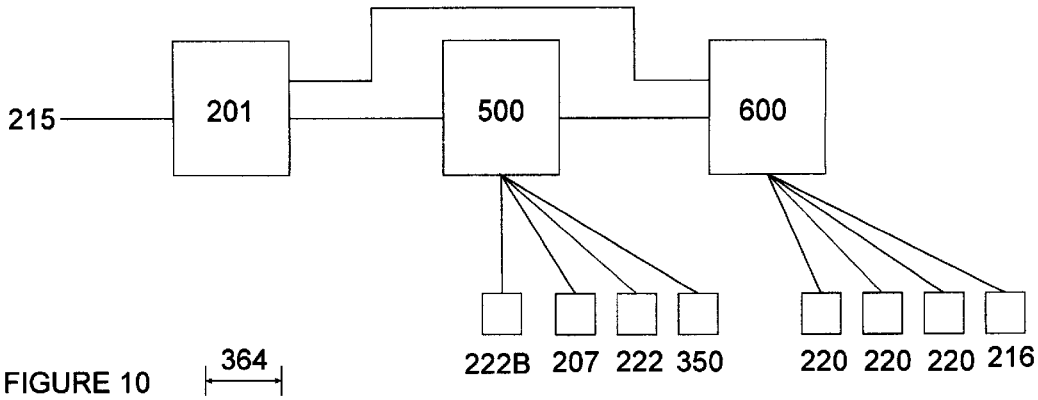
FIGURE 10
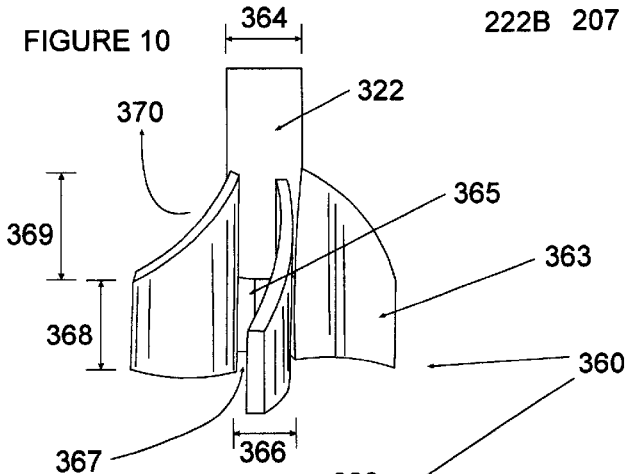
FIGURE 12
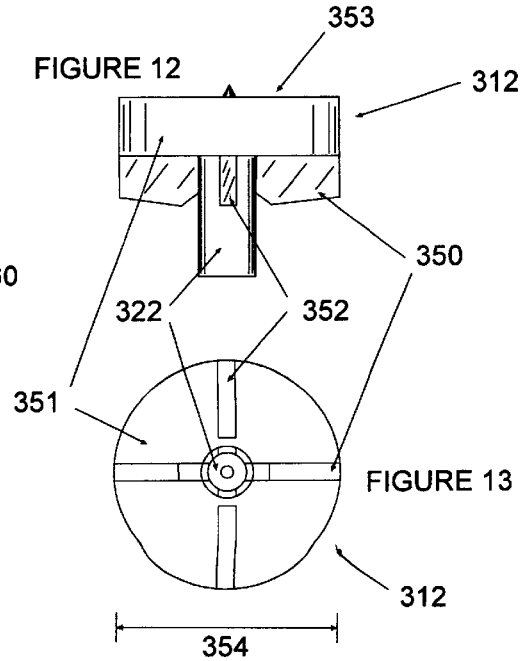
FIGURE 13
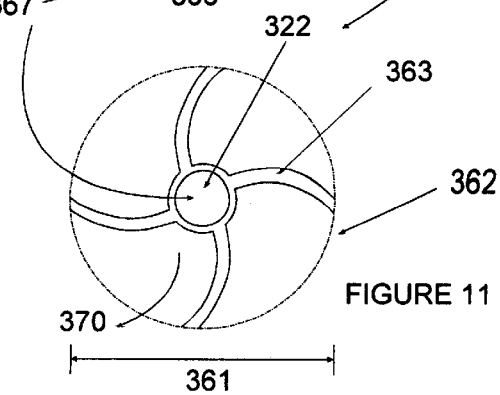
FIGURE 11

BOTTLED WATER DISPENSER FILLING DEVICE AND KIT THEREFORE

BACKGROUND OF THE INVENTION

The present invention relates to bottled water dispense filling devices, more particularly with reference to kits therefore.

The present state of the art in bottled water dispenser filling devices are reflected in the following devices. The devices lack an pump effective for transferring high volumes of water without the need for priming.

U.S. Pat. No. 4,174,743 describes an integrated apparatus or device for transferring, that is, pumping water from a water bottle to a water fountain having a reservoir with a dispensing faucet. A housing is provided carrying a stopper for insertion into the neck of a water bottle. Within the housing, there is a pump; a tube is connected to the pump discharge and extends through the stopper for pumping air into the bottle. A further tube passes through the stopper for transferring water from the bottle. The other end of this tube extends to fitting means which can be placed on the reservoir in a position normally occupied by the water bottle in an inverted position. This fitting carries a float valve which closes the end of the supply tube when the reservoir is filled.

U.S. Pat. No. 5,495,725 describes a water transport system replaces the inverted water bottle on a conventional bottled water cooler of the type with a refrigerated, open top water reservoir. The system automatically transfers water from an upright water bottle below the reservoir into the reservoir whenever water in the reservoir falls below a predetermined level. A water pipe carries water from the bottle, through a sealed closure in the bottle neck and up into the reservoir whenever air pressure in the bottle is elevated. An air pump in a housing atop the reservoir generates air pressure in an air tube passing through the closure and into the bottle. A water level sensor reduces air pressure in the system when the water in the reservoir reaches a predetermined level to thereby automatically control refilling of the reservoir.

U.S. Pat. No. 5,638,991 describes a direct dispensing device without intermediate reservoir for a standard five gallon container or bottle. Consistent with other prior art devices, the pump does not extend into the bottle.

SUMMARY OF THE INVENTION

The present invention is a novel pump and regulator which may optionally be combined with a collapsible enclosing cabinet for the pump and water bottle to form a kit.

BRIEF DESCRIPTION OF THE DRAWINGS

FIG. 5A is an enlarged section of FIG. 5.

FIG. 9 is a generalized flow diagram for the control electronics for the present invention.

FIGS. 10 and 11 are, respectively, perspective and bottom views of the lower impeller for the invention pump with a broken away section of the impeller shaft.

FIGS. 12 and 13 are, respectively, side and bottom views of the rotor assembly at the top part of the pump shaft for additional pumping force for water transfer from the bottle to the dispenser reservoir.

DETAILED DESCRIPTION OF THE INVENTION

The technology disclosed below is discussed with reference to the Figures. Where an item number is used in separate drawings, the item identified is substantially the same in function and construction.

Figure 1:
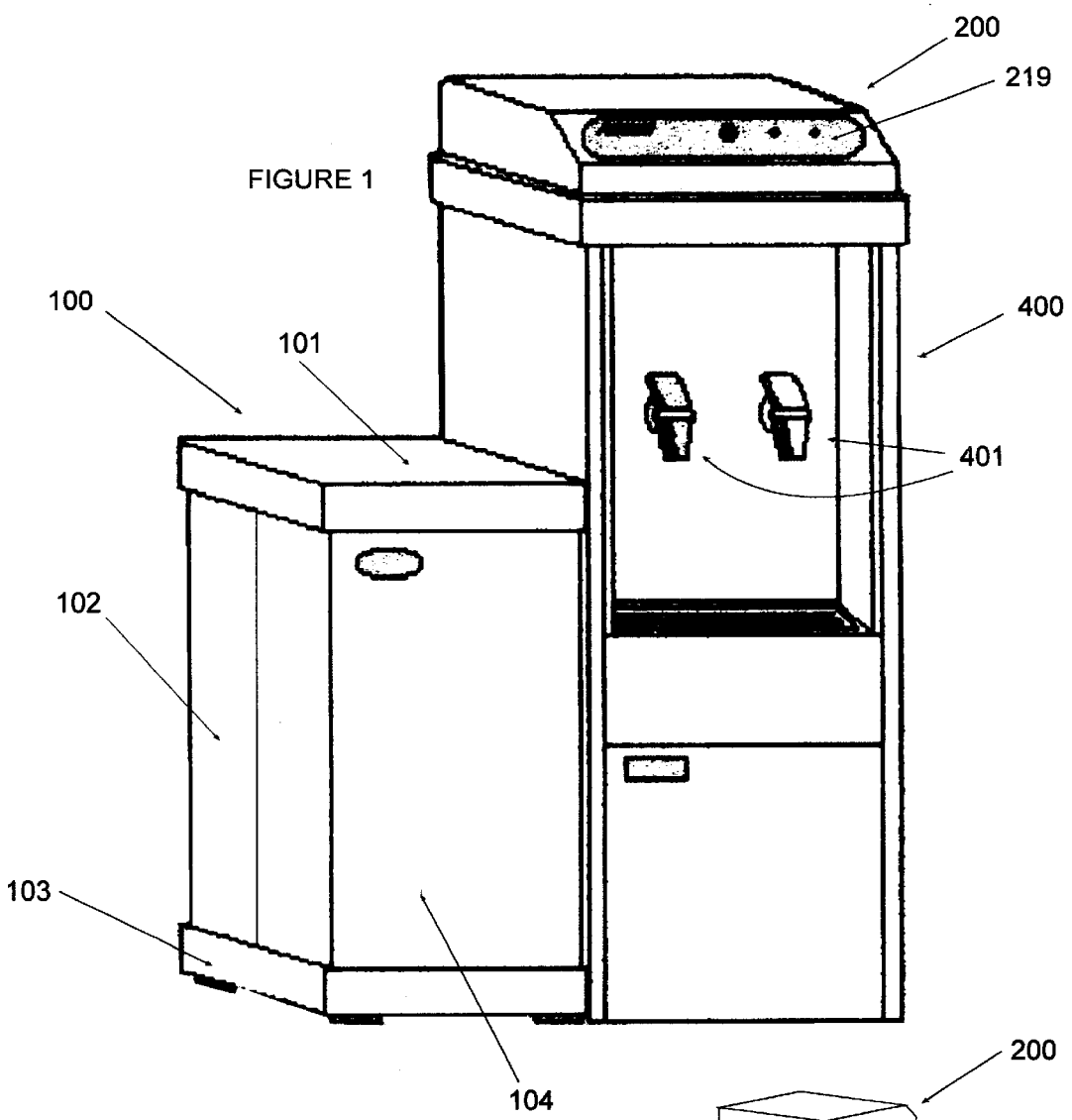
FIG. 1 is a front view of the invention system of a regulator mounted on the top hole of a prior art bottled water dispensing device, having placed next to that assembly a collapsible cabinet enclosing a water bottle with the invention pump attached thereto.
Figure 1A:
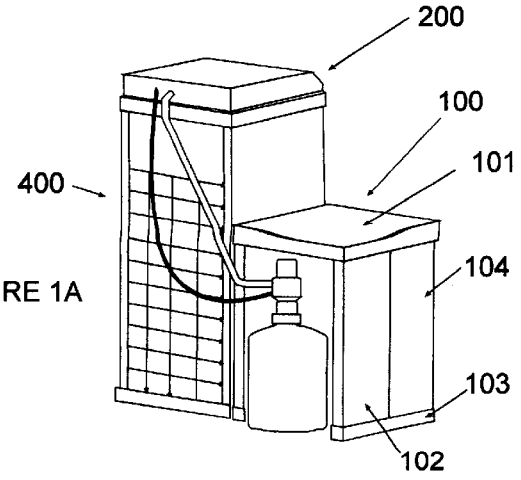
FIG. 1A is a rear view of the invention system of FIG. 1 whereby are shown the invention pump mounted on a water bottle, the combination enclosed in a cabinet.

FIG. 1 shows a prior art water dispenser 400 with hot and cold spouts 401. Dispenser is constructed with hole 402, as in FIG. 8, adapted to permit inversion of a five gallon water bottle such that the top sloped "shoulder" area of the bottle supportingly engages the edge of hole 402. Regulator 200 in FIG. 1 is shown covering generally the entire horizontal top surface of dispenser 400 and hole 402, creating a pleasant and efficient appearance. Cabinet 100 comprises top 101, collapsible side walls 102, base 103 and U-shaped front and partial side walls 104. Cabinet 100 encloses for aesthetic appearance the pump assembly 300 and a water bottle for transferring water via a tube 310 from the water bottle to the water reservoir in dispenser 400, which reservoirs typically contain 1–2 gallons and have a reservoir depth of about 1–2 feet from the hole 402 to the bottom of the reservoir.

Figure 2:
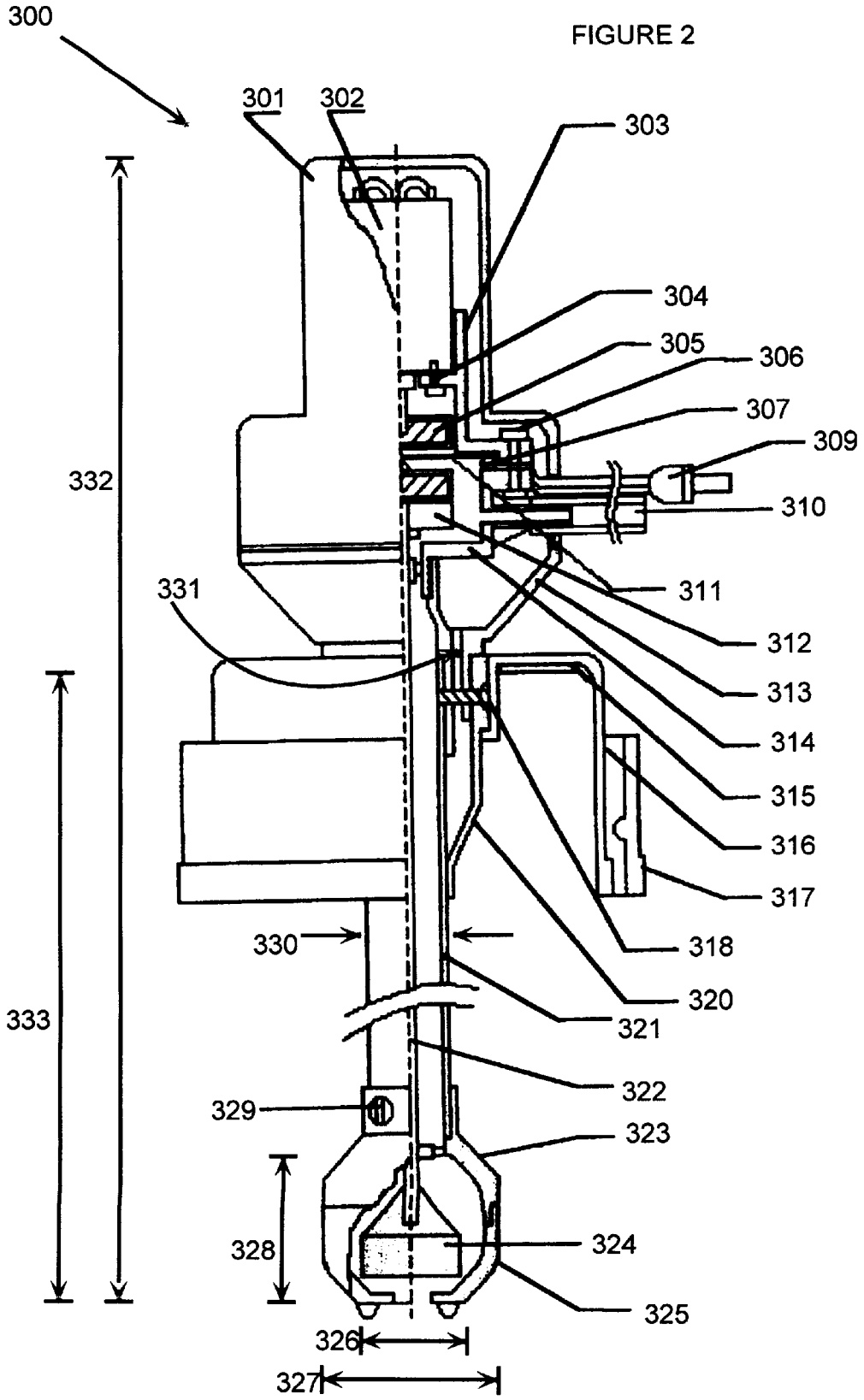
FIG. 2 is a partially cut away side view of the pump assembly of the present invention including cap means for mounting the pump in a standard five gallon water bottle for bottled water.

FIG. 2 shows the pump assembly 300 of the present invention. Housing 301 encloses the pump motor 302 (12V, DC motor preferably with the capability of 10,000 rpm and ability to transfer about 1–5 gallons per minute with the present embodiment) and tube connections. The motor 302 is sealed against the fluid flow conduits and cavities with seal plate 311 and O-ring 307, thereby eliminating the potential of short circuit for the pump motor 302. Motor 302 is mounted in base 303 with screws 304 and 306. Electrical cord 309 provides low voltage to the motor 302. Tube 310 is connected to a continuous conduit from the pump impeller 324 to the top water outlet of the pump assembly 300, thereby providing liquid access to in the water bottle on which the assembly 300 is mounted, the mounting provided by pressing cap means (comprising cap seal 315, cap 316 and bottle turning cap 317) to the top of an upright standard five gallon water bottle for bottled water.

Motor side rotor 305 magnetically engages water side rotor 312 for rotation of shaft 322, the shaft 322 having its distal end impeller 324. A housing tube 321 is connected with tube connector 313, which is in turn connected with cap 316 by screw 318. This secure connection is important to provide a major portion of the water conduit for the bottled water moving from the bottle to the top pump outlet to tube 310. Tube 321 has an outside diameter 330 sufficient for a polypropylene tube to provide non-collapsing support for positive pressure for the pumping of the present invention, the inside diameter of tube 321 preferably ranging from about 10–25 millimeters and more preferably from about 12–17 millimeters. Pump impeller top cover 323 and base 325 provide a liquid tight connecting cavity to tube 321, whereby in the bottom of base 325 is a hole for drawing into that cavity bottled water by action of the screw type impeller 324. Impeller 324 generally has a frusta-conical construction with the broader section below (as shown in FIG. 2 with a diameter 326 of about 10–15 millimeters), extending upward to connect with shaft 322, the frusta-conical surface appropriately scored to provide impulsion of water from the bottom hole of base 325 to tube 321 and thereafter to tube 310 for transmission to regulator 200 for filling the reservoir of dispenser 400. Vent hole 331 provides air inflow to a water bottle to prevent vacuum in the bottle. Top 323 and base 325 have a cross section width of about 30 millimeters to provide a widest internal cavity diameter of about 20–24 millimeter.

Top 323 and base 325 have a preferred height of about 25–40 millimeters. Height 333 from the bottom edge of base 325 to the top outer surface of cap 316 is about 450 millimeters. Height 332 from the bottom edge of base 325 to the top outer surface of housing 301 is about 570 millimeters, providing a pump assembly 300 which, after insertion of the tube 321/shaft 322 portion of assembly 300 into a standard water bottle of five gallons capacity, rises from the surface on which the upright water bottle rests, of only about 580–590 millimeters.

Figures 3, 4:
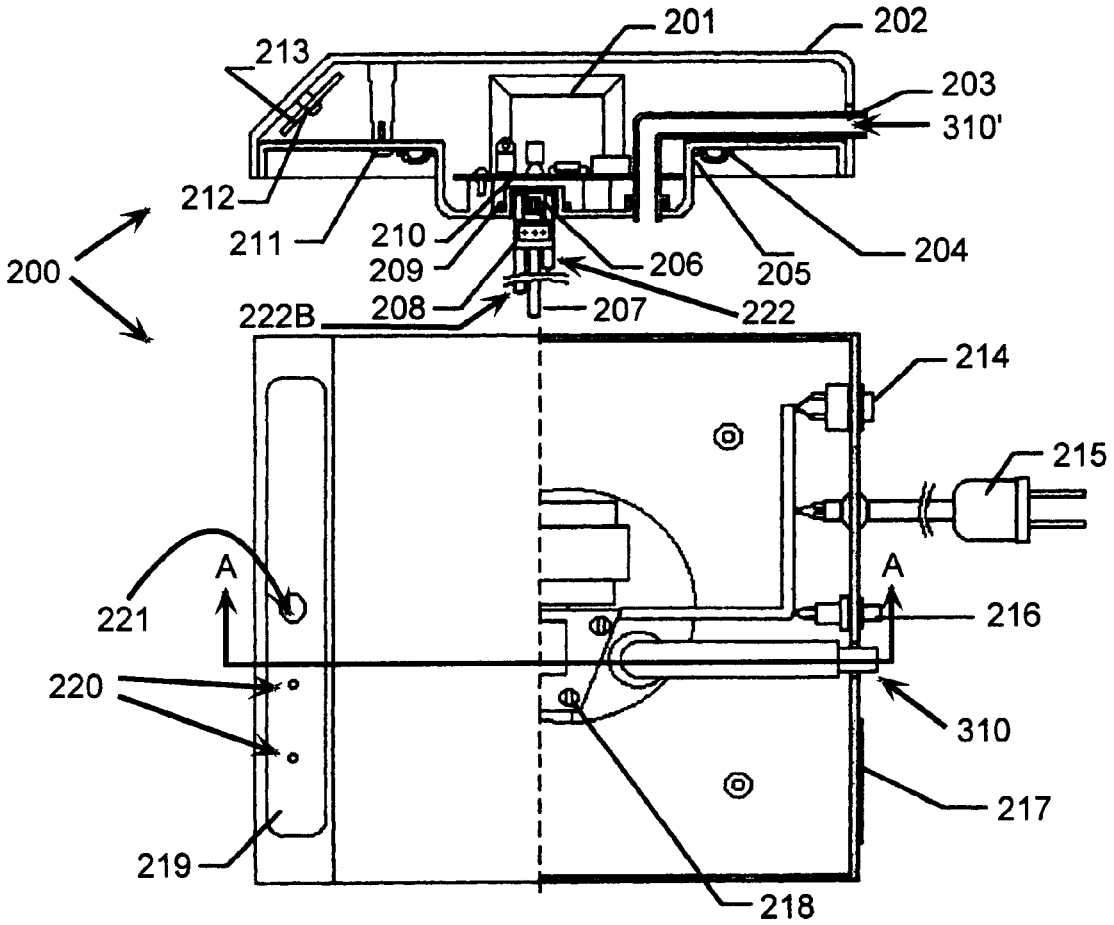
FIG. 4 is a top partially cutaway view of the regulator of the present invention.
FIG. 3 is section AA of FIG. 4.

Regulator 200 as shown in FIGS. 3 and 4 comprise a covering housing 202 providing aesthetic appearance to cover the top of dispenser 400 and hole 402. In the present invention, covering housing for a prior art dispenser 400 comprises, as in FIG. 8, a height 225 of about 50–60 millimeters, width 223 of about 290–310 millimeters and depth 224 of about from 290–310 millimeters. Cover 202 also provides protection for the regulator means for the present invention and support for indicator lights 220 and reset button 221. Regulator means comprise 120VAC supply cord 215 connecting with transformer 201, which provides low voltage power to the pump assembly and the rest of the regulator means. Regulator means provides means at least for turning on the pump motor on and off, but may include means for sensing and indicating high and low levels in the dispenser 400 reservoir and turning the pump motor 402 on or off appropriately in response thereto, means for sensing water flow from the pump assembly 300 to the dispenser 400 reservoir when the regulator means turns the pump motor on as a means of detecting an empty water bottle.

In FIG. 3, tube 203 is adapted to sealingly connect to tube 310 such that water flow 310' is directed to an outlet distal to that connection such that dispenser 400 reservoir receives the flow. High level sensor 222, low level sensor 222B and common sensor 207 are located in that reservoir when regulator 200 is in place on dispenser 400 as shown in FIG. 1. Sensors 222, 222B and 207 detect water level and send signals to IC means 500, as in FIG. 9, such that respectively the pump motor 402 is either turned on or off. The pumping capacity of the pump assembly is so unexpectedly high that power usage is very low for any individual refilling of dispenser 400 reservoir to the high level sensor 222. A sensor 350 may be located anywhere in the several conduits between the water bottle and reservoir according to this embodiment whereby water flow may be sensed when the pump motor 402 is turned on. If no water flow is sensed, switch means 600, as shown in FIG. 9, causes the pump motor to be turned on and an indicator light 220 to indicate an water bottle without the need to open cabinet 100 to check it. Indicator lights 220 also respond through switch means 600 to show a high or low level in dispenser 400 reservoir.

As in FIG. 3, circuit board 210 provides electrical connection and support for most of the electrical components of the regulator means. Indicator lights 220 and reset button 221 are supported and presented to the exterior of housing 202 on panel 219 with display board 213 and connecting screws 212. Located on a lower housing portion base 205 of housing 202 is circular elastomer seal 204, adapted to provide a substantially air tight seal between the outside air and the liquid side of the conduits and the reservoir of this embodiment. Sensors 207, 222 and 222B are provided with electrical connection 208, detector spring 206 and position twig 209. Base 205 is connected to the top portion of housing 202 with screws 211. Cord 216 provides power to pump motor 402 through the regulator means. An overall on/off switch 214 for regulator 200 is provided on the back side of the device.

Figure 5:
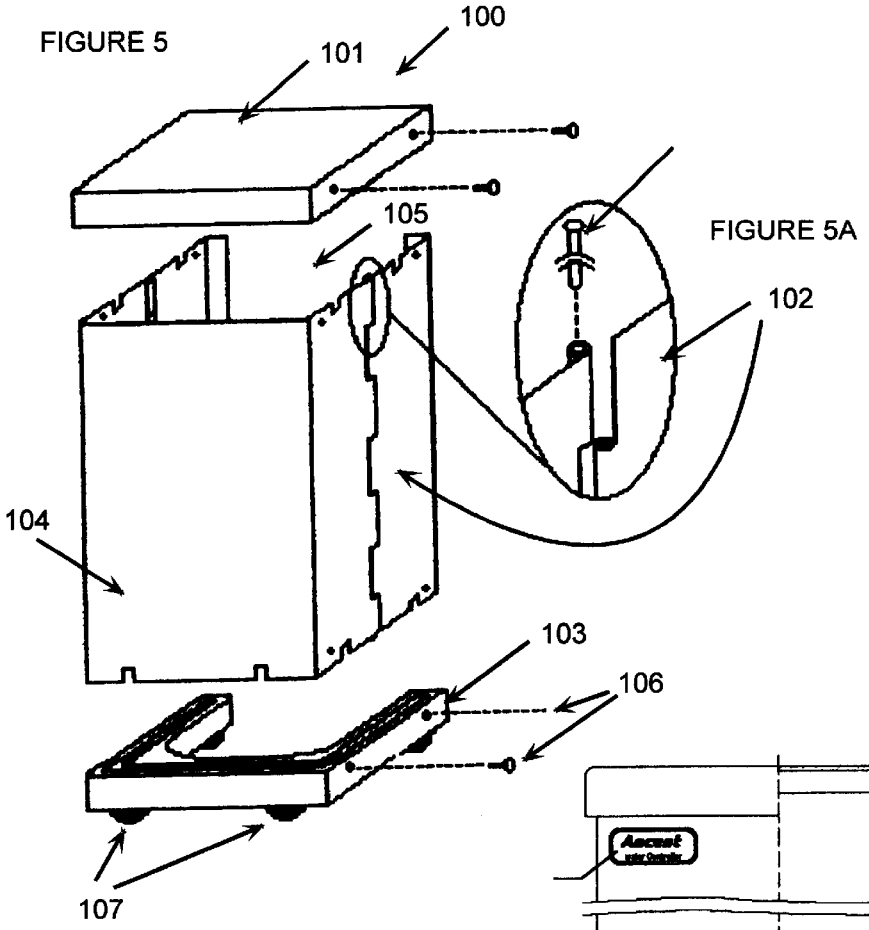
FIG. 5 is a perspective view of the collapsible cabinet of the present invention without a hinged door, the cabinet having a top, a base and a collapsible wall section.
Figure 6:
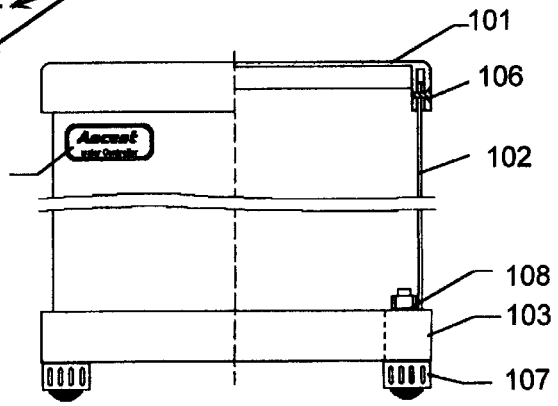
FIG. 6 is a front view of the collapsible cabinet of FIG. 5 showing the front hinged door for enclosing the pump assembly and the water bottle.

FIG. 5 shows top 101 having, in a top view, a generally square shape appropriate for enclosing the diameter of a standard five gallon water bottle. Collapsible sides 102 comprise a pair of hinged narrow sections 102, hingeably connectable to U-shaped front and partial side walls 104. The bottom edges of the U-shaped front and partial side walls 104 and collapsible sides 102, as shown in FIG. 5 and 5A, are connectable to base 103 with screws 106 in a groove cut into an upper surface thereof. Base 103 comprises rollers 107 at the bottom side of the four corners of its U-shape having approximately the same horizontal extent as top 101. As shown in FIG. 6, U-shaped front and partial side walls 104 presents a front panel for hiding the water bottle and pump assembly 300, as well as the connecting water tubing and electrical cord. Rollers 107 and base 103 are connected with bolts 108, thereby providing slidable removal of the cabinet away from the water bottle and pump assembly 300 for replacement of the water bottle.

Figure 7:
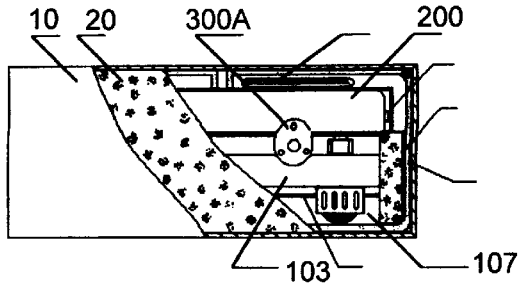
FIG. 7 is a partially cut away side view of the entire invention cabinet, pump assembly and regulator in a kit form.

FIG. 7 shows pump assembly 300A, base 103, regulator 200 in a kit form in box 10 with packing 20. All the components of the present invention, excepting dispenser 400 and the water bottle are included in the compact kit box as shown, the box having approximate dimension of less than about 800×500×500 millimeters.

Figure 8:
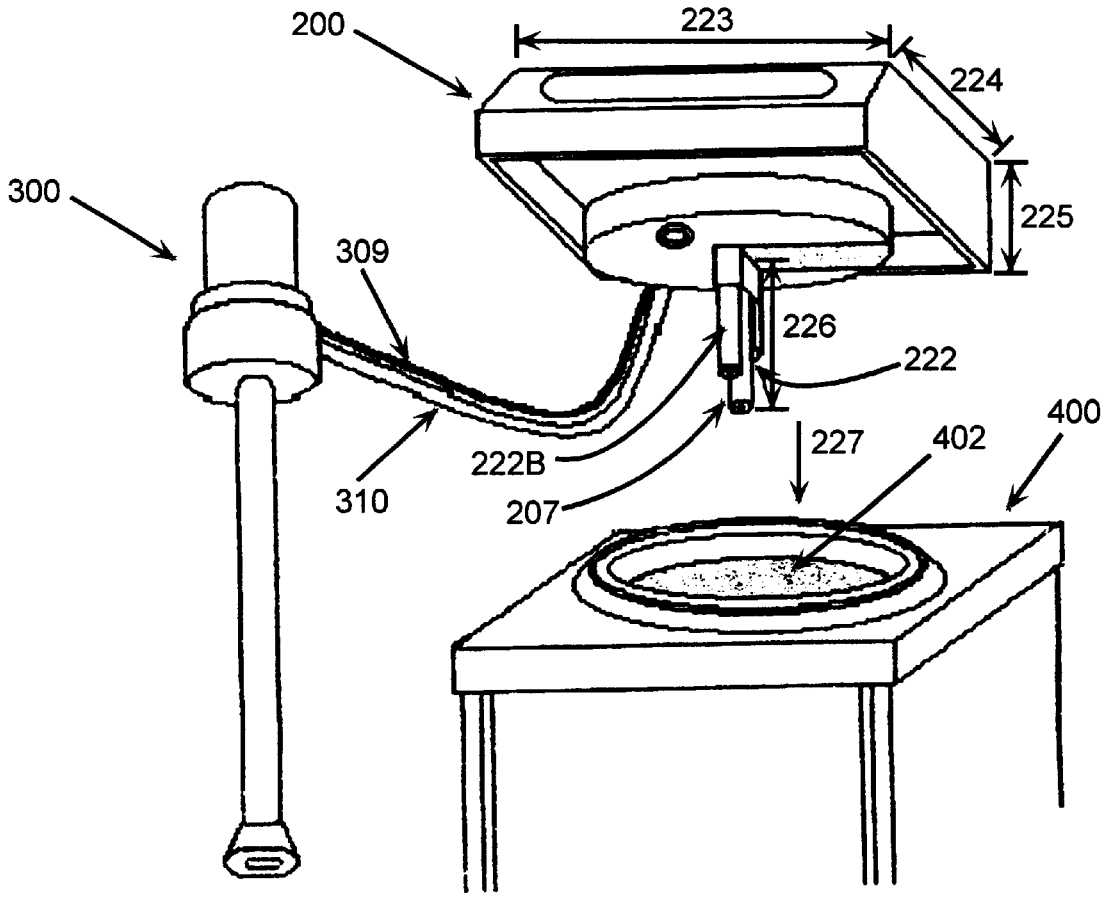
FIG. 8 shows the pump assembly and regulator in relation to the open hole in a prior art bottled water dispenser, the regulator adapted to be sealingly inserted therein.

FIG. 8 shows pump assembly 300 connected by cord 309 and conduit 310 to regulator 200, such regulator 200 to be applied to the top of dispenser 400 and partially through hole 402 in direction 227. After application of regulator 200 to the top of dispenser 400, pump assembly 300 is sealingly inserted as above in a five gallon water bottle. The pump assembly 300 and water bottle are hidden in cabinet 100. It is a further improvement of the present invention to eliminate dispenser 400 and provide an equivalent reservoir and dispenser supported above the top 101 of cabinet 100.

FIGS. 10 and 11 disclose details of the lower impeller 360 (impeller 324 of FIG. 2). FIGS. 12 and 13 disclose details of the rotor 312, which comprises additional impeller blades, thereby on the same shaft 322 providing dual pumping force in this pump assembly 300. Impeller 360 generally comprises four impeller blades 363 defining at their greatest lateral reach from shaft 322 the broken line circle 362 having a diameter 361 of about 15 millimeters. The curved impeller blades 363 are supportively connected to shaft 322 for only an portion upper portion 369 of about 5 millimeter, leaving an open axial space beneath the end of the shaft with a height 368 of about 5.5 millimeters and a cylindrical diameter 366 of about 3 millimeters. Moving the shaft counterclockwise in water as to FIG. 11, water is drawn into the open axial space along path 367 and expelled with great force along path 370, thereby driving the water up tube 321 to its top which has fluid connection with the chamber enclosing the rotor 312 as shown in FIGS. 12 and 13.

The magnetically coupling core of the water side of the pump is enclosed in case 351, which has extending downward from it straight and vertical upper impeller blades 350 and 352. It may be readily appreciated by inspection of FIG. 2 the the orientation of the impeller blades about the shaft 322 further drives water from tube 321 into conduit 310 by the approximately later relationship between the pump assembly connection of conduit 310 and impellers 350 and 352. The diameter 354 of the rotor impeller blade rotation is about 10–15 millimeters.

Figure 14:
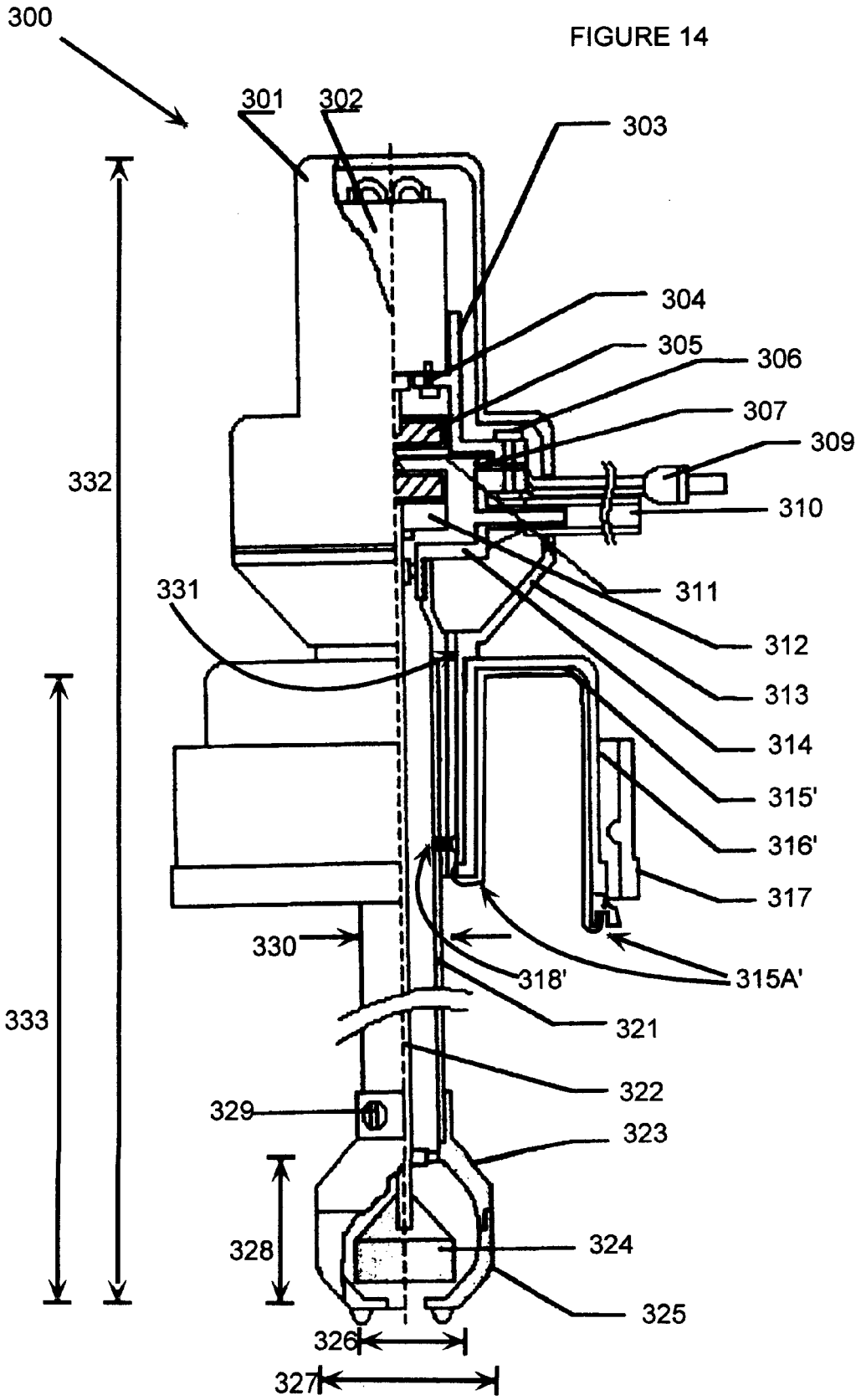
FIG. 14 shows the device substantially as shown in FIG. 2 except with an inner cap lining permitting application thereof to a broader range of bottle top diameters.

FIG. 14 shows substantially the device of FIG. 2 although having a modified cap 316' with a bonded interior heavy rubber gasketing material 315' substantially covering the inside surface of cap 316', the material 315' defined by circumferential outside and inside edges 315A'. This adaptation of the cap broadens the number of several types of water bottles available to the consumer, i.e., water bottles are made of heavy gauge glass and comparatively thin gauge polymer.

The above design disclosures present the skilled person with considerable and wide ranges from which to choose appropriate obvious modifications for the above examples. However, the objects of the present invention will still be obtained by the skilled person applying such design disclosures in an appropriate manner.

I claim:

1. A pump for a bottled water bottle, the improvement comprising:

(a) a low voltage pump motor, a water side rotor magnetically engageable to the pump motor and sealed apart from the pump motor, a relatively long shaft extending from one end connected to the water side rotor to a lower impeller at the other end;

(b) a water bottle cap adapted to be secured to a top of a five gallon water bottle and having a hole through an upper surface of the cap; and (c) a housing about the impeller with a liquid draw hole at a bottom end of the housing, the housing further sealingly and supportively connected with a first end of a tube enclosing the shaft, a second end of the tube sealingly and supportively connected to a housing for enclosing the water side rotor, and an outside portion of the tube toward the second end of the tube sealingly and supportively secured to the edges of the water bottle cap hole.

2. The pump of claim 1 wherein the shaft has a length such that when the cap is secured to a water bottle, the housing for the impeller comes within about 2–20 millimeters of the bottom of the water bottle.

3. The pump of claim 1 wherein the shaft comprises a diameter of about 2–5 millimeters and the tube has an internal diameter of about 10–20 millimeters.

4. The pump of claim 3 wherein the shaft has a length such that when the cap is secured to a water bottle, the housing for the impeller comes within about 2–20 millimelters of the bottom of the water bottle.

5. The pump of claim 4 wherein the housing for the impeller is adapted to form a cavity therein such that when the cap is secured to a filled water bottle in an upright position and the impeller rotates at high speed, water is expelled from an outlet of the housing for the water side rotor at about 1 to 5 gallons per minute.

6. The pump of claim 5 wherein a conduit is connected from the outlet of the housing of the water side rotor to a reservoir of a bottled water dispenser.

7. The pump of claim 6 wherein regulator means comprise means for turning the pump motor on and off.

8. The pump of claim 7 wherein the regulator means comprise sensors for high and low levels of water in the dispenser reservoir, whereby a sensed high level will cause the pump motor to turn off and a sensed low level will cause the pump motor to turn on.

9. The pump of claim 8 wherein a pumped water flow sensor is located to detect the flow of water when the pump is turned on, whereby the pumped water flow sensor is connected to switch means for turning the pump off when no water is sensed by the pumped water flow sensor.

10. The pump of claim 8 wherein a regulator comprises a housing supporting and enclosing the regulator means and a portion of the conduit extending from the pump to the dispenser reservoir.

11. The pump of claim 10 wherein a cabinet comprises two sidewalls, a U-shaped front wall and partial sidewalls hingedly connected with the two sidewalls, the combination of these elements with a base and a top comprising a decorative stand-alone cover for an assembly of the pump mounted on a water bottle.

12. The pump of claim 11 wherein the cabinet, regulator and assembly of the pump motor, shaft, tube, housing and impeller comprise a kit adapted to be enclosed in a package which may be carried by a single person.

* * * * *